US008013294B2

(12) United States Patent
Suyama et al.

(10) Patent No.: US 8,013,294 B2
(45) Date of Patent: Sep. 6, 2011

(54) CHARGED-PARTICLE DETECTOR

(75) Inventors: Motohiro Suyama, Hamamatsu (JP); Takayuki Ohmura, Hamamatsu (JP); Hiroshi Kobayashi, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 122 days.

(21) Appl. No.: 12/607,410

(22) Filed: Oct. 28, 2009

(65) Prior Publication Data

US 2011/0095174 A1 Apr. 28, 2011

(30) Foreign Application Priority Data

May 30, 2008 (JP) ..... 2008-143403

(51) Int. Cl.
*H01J 49/40* (2006.01)
*H01J 43/00* (2006.01)

(52) U.S. Cl. ..... 250/287; 313/103 CM; 313/103 R; 313/533

(58) Field of Classification Search ..... 250/281, 250/282, 287, 305, 299; 313/103 CM, 103 R, 313/105 CM, 105 R, 533–536
See application file for complete search history.

(56) References Cited

U.S. PATENT DOCUMENTS

| | | | | |
|---|---|---|---|---|
| 5,770,858 | A | 6/1998 | Fuchs et al. | |
| 6,617,768 | B1 * | 9/2003 | Hansen | 313/103 CM |
| 2004/0108451 | A1 * | 6/2004 | Hansen | 250/281 |
| 2010/0243887 | A1 * | 9/2010 | Suyama et al. | 250/287 |

* cited by examiner

*Primary Examiner* — Bernard E Souw
(74) *Attorney, Agent, or Firm* — Drinker Biddle & Reath LLP

(57) ABSTRACT

This ion detector includes an MCP and a plurality of planar dynodes respectively having a plurality of slits. The plurality of planar dynodes are stacked via spacers parallel to an electron output plane of the MCP, and the first stage planar dynode is opposed parallel to the electron output plane. In accordance with this ion detector, it is possible to obtain output signals having the linearity reaching mV order, and to shorten its pulse width to approximately 600 ps.

6 Claims, 6 Drawing Sheets

CHARGED-PARTICLE DETECTOR

BACKGROUND OF THE INVENTION

1. Field of the Invention

The present invention relates to a charged-particle detector which is disposed in a vacuum chamber of a mass spectroscope or the like, to detect ions or electrons.

2. Related Background Art

A mass spectroscope performs mass spectrometry of ions by utilizing the fact that ions flying in a specific place differ in trajectory or velocity depending on their mass. That is, in the case in which ions are deflected by an electric field and/or a magnetic field, their deflection amounts are different depending on their mass, and therefore, the incoming positions of the ions to an ion detector are different depending on their mass. Further, in the case in which ions are accelerated in an electric field, the flying velocities of the accelerated ions are different depending on their mass, and therefore, the incoming timings of the ions to the ion detector are different depending on their mass.

A mass spectroscope utilizing the latter principle is called a TOF (Time of Flight) type mass spectroscope. In a TOF type mass spectroscope, an ion having a different flying velocity because of its different mass is detected by an ion detector, and a time until the ions reach the ion detector is measured. Such a TOF type mass spectroscope is described in, for example, Patent Document 1 (U.S. Pat. No. 5,770,858), and a micro-channel plate (MCP) is used as an ion detector.

SUMMARY OF THE INVENTION

However, in a conventional ion detector, the output range within which the linearity of outputs can be retained is limited. The reason for this is that, because an MCP is highly-resistive, and when a quantity of output electrons from the MCP is greater than a predetermined value, electrons to be output per unit time from the MCP are depleted, which makes it impossible to retain the linearity thereof. In particular, it is possible to more-precisely separate the arrival times of ions with an ion detector capable of achieving outputs of high linearity in a state of retaining the high-speed responsivity of the MCP, and therefore, the ion detector can be applied to a highly accurate mass spectrograph.

The present invention has been achieved in consideration of the problem, and an object of the present invention is to provide an ion detector which is fast in response speed, that is capable of expanding its output range within which the linearity can be retained.

In order to solve the above-described problem, a charged-particle detector according to the present invention includes a micro-channel plate (MCP), and a plurality of planar dynodes respectively having a plurality of slits, and the plurality of planar dynodes are stacked via spacers parallel to an electron output plane of the MCP, and the first stage planar dynode is opposed parallel to the electron output plane.

In a conventional MCP, when a quantity of electrons emitted per unit time from the MCP is increased, there is a tendency that electrons inside the MCP will be depleted, and the linearity of a quantity of output electrons to the quantity of ions coming into the MCP will not be retained. On the other hand, provided that a multiplication factor of the MCP is set to be low in order not to deplete a quantity of electrons output from the MCP, it is possible to retain the linearity. In the present invention, because the planar dynodes are stacked to further multiply electrons in the subsequent stage of the MCP, it is possible to retain the linearity in a wide dynamic range while electrons are sufficiently multiplied.

In particular, each of the stacked planar dynodes has a plurality of slits, and electrons are multiplied at the interior surfaces of the slits, and the first stage planar dynode is opposed parallel to the electron output plane of the MCP. Accordingly, electrons at each position in the planes of the planar dynodes advance together, and the electrons advance along the thickness direction of the dynodes while colliding against the interior surfaces of the slits so as not to widely meander. Therefore, in accordance with the charged-particle detector of the present invention, it is possible to not only retain the linearity of outputs, but also accelerate its response speed.

Further, each channel of the MCP to which the first stage dynode is opposed is inclined toward the thickness direction of the MCP, and assuming that a straight line passing through the center of each channel is set as a first straight line, a direction perpendicular to both of the longitudinal direction of the slits and the thickness direction of the planar dynodes is set as a width direction, and a straight line connecting a midpoint in the width direction of an opening on an electron incoming plane side and a midpoint in the width direction of an opening on an electron emission side in the slit of the first stage planar dynode is set as a second straight line, it is preferable that an inclination of the first straight line and an inclination of the second straight line face in opposite directions to each other with respect to the thickness direction.

In this case, because the inclinations of the first and second straight lines are opposite to each other, electrons emitted along the first straight line from the MCP are to efficiently come into the interior surfaces of the slits which are to be along the second straight line, which makes it possible to improve the collection efficiency of electrons in the first stage dynode.

Further, in the above-described charged-particle detector, it is preferable that an electrode on the electron output plane side of the MCP includes a metal tube body fixed to its opening end, a conductive fixing member electrically connected to the metal tube body, a lead pin which is fixed to the conductive fixing member, and is connected to the first stage planar dynode via a resistor, and an insulating material into which the conductive fixing member is buried.

A bias voltage is applied to a portion between the electrode on the ion incoming plane side of the MCP and the electrode on the electron output plane side of the MCP. Because the electrode on the electron output plane side is connected to the first stage planar dynode via the metal tube body, the conductive fixing member, and the resistor, the MCP and the first stage planar dynode can be electrically connected with a simple structure, which enables a voltage therebetween to be easily set through the resistor.

Further, in the above-described charged-particle detector, it is preferable that an outer diameter of a portion adjacent to the MCP of the metal tube body is less than an outer diameter of the MCP parallel to the outer diameter. In this case, because the electrode on the ion incoming plane side of the MCP and the portion adjacent to the MCP of the metal tube body do not directly face each other, discharge therebetween is inhibited.

Further, in the above-described charged-particle detector, it is preferable that the metal tube body has openings in its side wall, and the inside of the metal tube body and the outside thereof are communicated with each other via the openings. Because the charged-particle detector is disposed in vacuum (in a decompression environment less than one atmospheric pressure) to an extent that it is possible for ions to fly linearly such as in a chamber of a mass spectroscope, the inside of the chamber and the inside of the metal tube body are sufficiently communicated with each other via the above-described openings, and it is possible to sufficiently decompress the inside of the metal tube body to a vacuum state, and to inhibit the emergence of a difference in atmospheric pressure between the inside of the chamber and the inside of the metal tube body.

In accordance with the charged-particle detector according to the present invention, it is possible to have a high response speed in a state in which the linearity is retained in a wide dynamic range.

DESCRIPTION OF THE PREFERRED EMBODIMENTS

Figure 1:
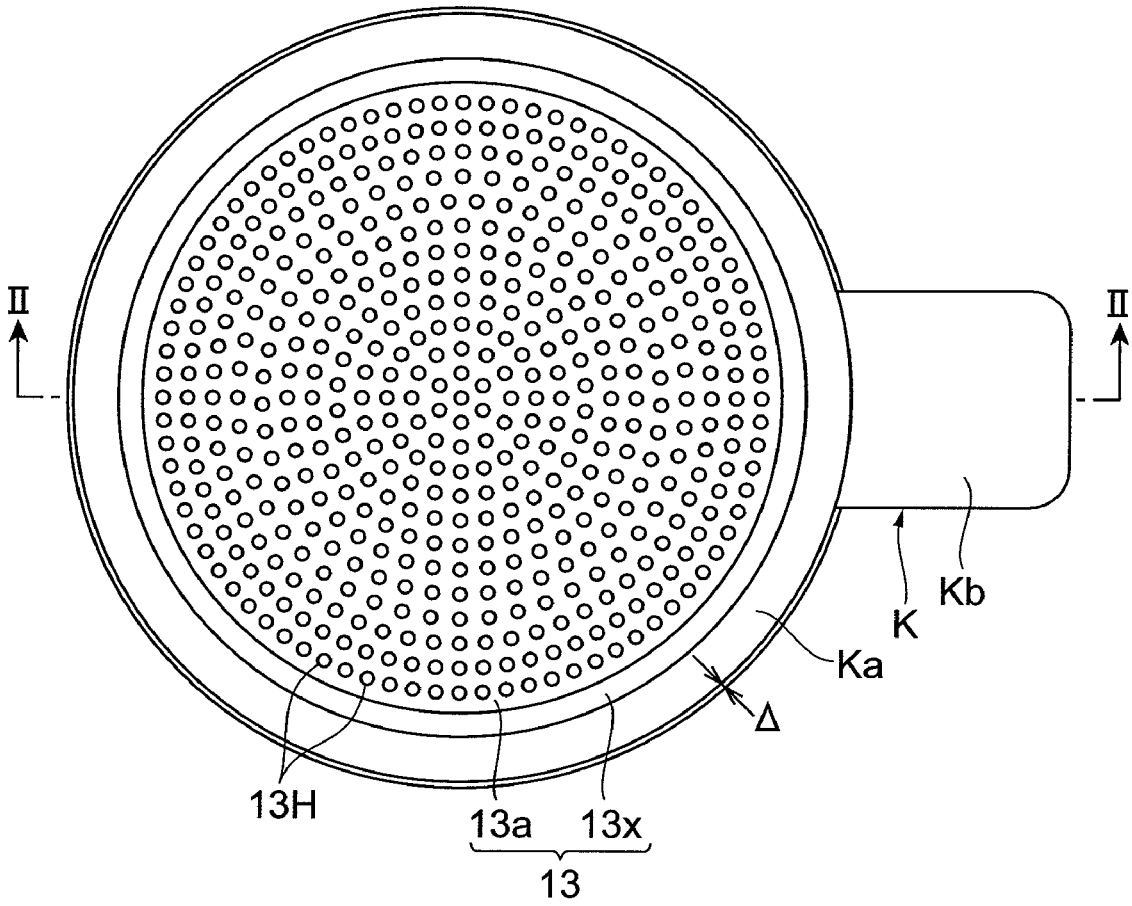
FIG. 1 is a plan view of an ion detector according to an embodiment.

Hereinafter, a charged-particle detector according to an embodiment will be described by using an ion detector as an example. Note that the same components are denoted by the same reference numerals and letters, and overlapping descriptions will be omitted.

FIG. 1 is a plan view of an ion detector according to an embodiment.

The ion detector includes a micro-channel plate (MCP) 13. The main body of the MCP 13 is formed of an insulating body such as glass, and has a plurality of through holes 13H extending so as to be slightly inclined toward its thickness direction. A secondary electron emission material is formed on the inner walls of the through holes 13H functioning as an electron incoming plane (electron-multiplier plane). A region in which the through holes 13H are formed is an effective region 13*a* of the MCP 13, and a cathode electrode K is fixed to an annular peripheral region 13*x* located lateral to the effective region 13*a*. The cathode electrode K has an annular electrode Ka fixed to the peripheral region 13*x*, and a tab electrode Kb integrally extending outward from the outer circumferential surface of the annular electrode Ka. A wiring through which a cathode potential ($-HV_1$) is applied is connected to the tab electrode Kb.

Figure 2:
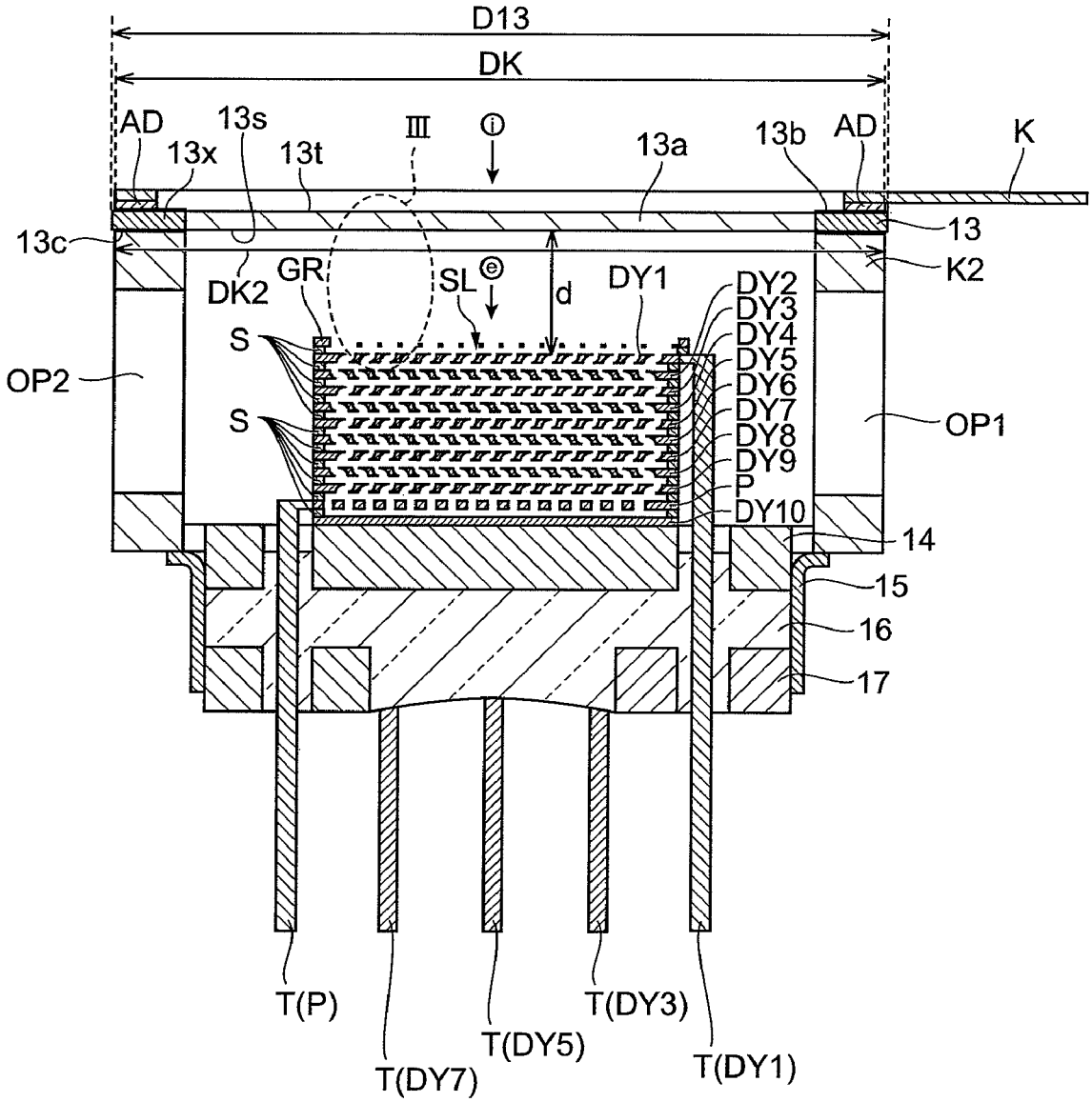
FIG. 2 is a cross-sectional view of the ion detector shown in FIG. 1 taken along the arrow II-II.

FIG. 2 is a cross-sectional view of the charged-particle detector shown in FIG. 1 taken along the arrow II-II.

The MCP 13 includes an outer electrode 13*b* on the outer surface of the peripheral region 13*x*, and an inner electrode 13*c* on the inner surface. The outer electrode 13*b* of the MCP 13 located lateral to the effective region 13*a* is bonded to the cathode electrode K with a thermoplastic conductive adhesive AD. In the same way, the inner electrode 13*c* of the MCP 13 is bonded to one end surface of the metal housing K2 with a thermoplastic conductive adhesive (not shown). The shape of the metal tube body K2 is cylindrical, and openings OP1 and OP2 to allow the inside and the outside thereof to be communicated with are provided in its side wall. The outer diameter of the metal tube body K2 is slightly less than the outer diameter of the MCP, and the inner diameter thereof is approximately the same as the MCP effective region 13*a*. The portion on the metal tube body K2 side of the metal ring 15 is bent outward, and one opening end face of the metal ring 15 is fixed to the other end face of the metal tube body K2. The metal ring 15 is preferably formed of Kovar (FeNiCo alloy).

Note that resistance welding is applied to the metal tube body K2 and the metal ring 15. Because the respective components of the present ion detector are bonded with only adhesive with less degassing and resistance welding, the number of components is less and the assembly process is simpler than those of apparatuses assembled by screwing.

The inside of the metal ring 15 is filled with an insulating material 16 formed of insulating glass, and insulating rings 14 and 17 are buried so as to be spaced from each other in the tube axis direction in the insulating material 16, and the outer circumferential surfaces of the insulating rings 14 and 17 are fixed to the interior surface of the metal ring 15. The insulating rings 14 and 17 are preferably formed of glass-ceramics. Glass-ceramics has a low coefficient of thermal expansion, that provides a light blocking effect thereto.

A secondary electron multiplying apparatus having a plurality of dynodes is disposed in the metal tube body K2. This secondary electron multiplying apparatus has planar dynodes DY9, DY8, DY7, DY6, DY5, DY4, DY3, DY2, and DY1, and a grid electrode GR which are stacked via spacers S above a tabular final stage dynode DY10. An anode P is disposed between the final stage dynode DY10 and the previous stage dynode DY9. The final stage dynode DY10 is located on the insulating ring 14, that has no slit therein, and the final stage dynode DY10 is electrically connected to a lead pin T(DY10). The other dynodes DY1 to DY9 have a plurality of slits SL extending in a direction perpendicular to the sheet, and are respectively electrically connected to lead pins T(DY1) to T(DY9). Note that the grid electrode GR may be connected to a lead pin T(K).

The anode P has a plurality of openings in a meshed pattern, and some of the electrons emitted from the dynode DY9 pass through the anode P to reach the final stage dynode DY10. However, electrons reflected by the final stage dynode DY10 are collected by the anode P. The anode P is electrically connected to a lead pin T (P). The lower parts of the respective lead pins are buried in the insulating material 16, and the insulating material 16 physically supports the dynodes DY1 to DY10 and the anode P. The insulating material 16 composes the stem along with the metal ring 15. Note that the lead pins are formed of Kovar.

In this way, the metal plates having many slits to multiply electrons are stacked in ten stages on the MCP side of the stem, to compose the secondary electron multiplying apparatus. However, the slits SL formed in the dynodes DY1 to DY9 formed of the metal plates are formed by applying etching onto the metal plates. Openings are provided in the peripheral parts of the respective metal plates composing the dynodes DY1 to DY10 and the anode P, and ceramic balls serving as spacers S are fitted into the openings, and the respective metal plates are positioned in the thickness direction and the two-dimensional direction perpendicular to the thickness direction.

The opposed interior surfaces of the slits SL in the respective dynodes DY1 to DY9 are respectively curved centering on the axis perpendicular to the sheet, and a thin secondary electron multiplying material including aluminum oxide is deposited on these curved surfaces. Note that the sheet is parallel to the tube axis of the metal tube body K2, and is perpendicular to an electron output plane 13*s* of the MCP 13.

The respective dynodes DY1 to DY9 compose a metal-channel dynode or a venetian-blind type dynode.

When the ion detector is disposed in a vacuum chamber and positive ions are caused to fly, the positive ions are drawn by a negative potential of the ion detector to come into an ion incoming plane 13*t* of the MCP 13. The MCP 13 converts ions into electrons, and multiplies the electrons to transport those to the subsequent stage electron multiplying apparatus. The electron multiplying apparatus further multiplies the electrons multiplied by the MCP 13, to output those from the anode P.

As described above, this ion detector includes the MCP 13 and a plurality of the planar dynodes DY1 to DY9 respectively having a plurality of slits, and the plurality of planar dynodes DY1 to DY9 are stacked via the spacers S parallel to the electron output plane 13 s of the MCP 13, and the first stage planar dynode DY1 is opposed parallel to the electron output plane 13*s*. Electron incoming planes, i.e., electron-multiplier planes are formed in the respective slits in the planar dynodes.

Figure 3:
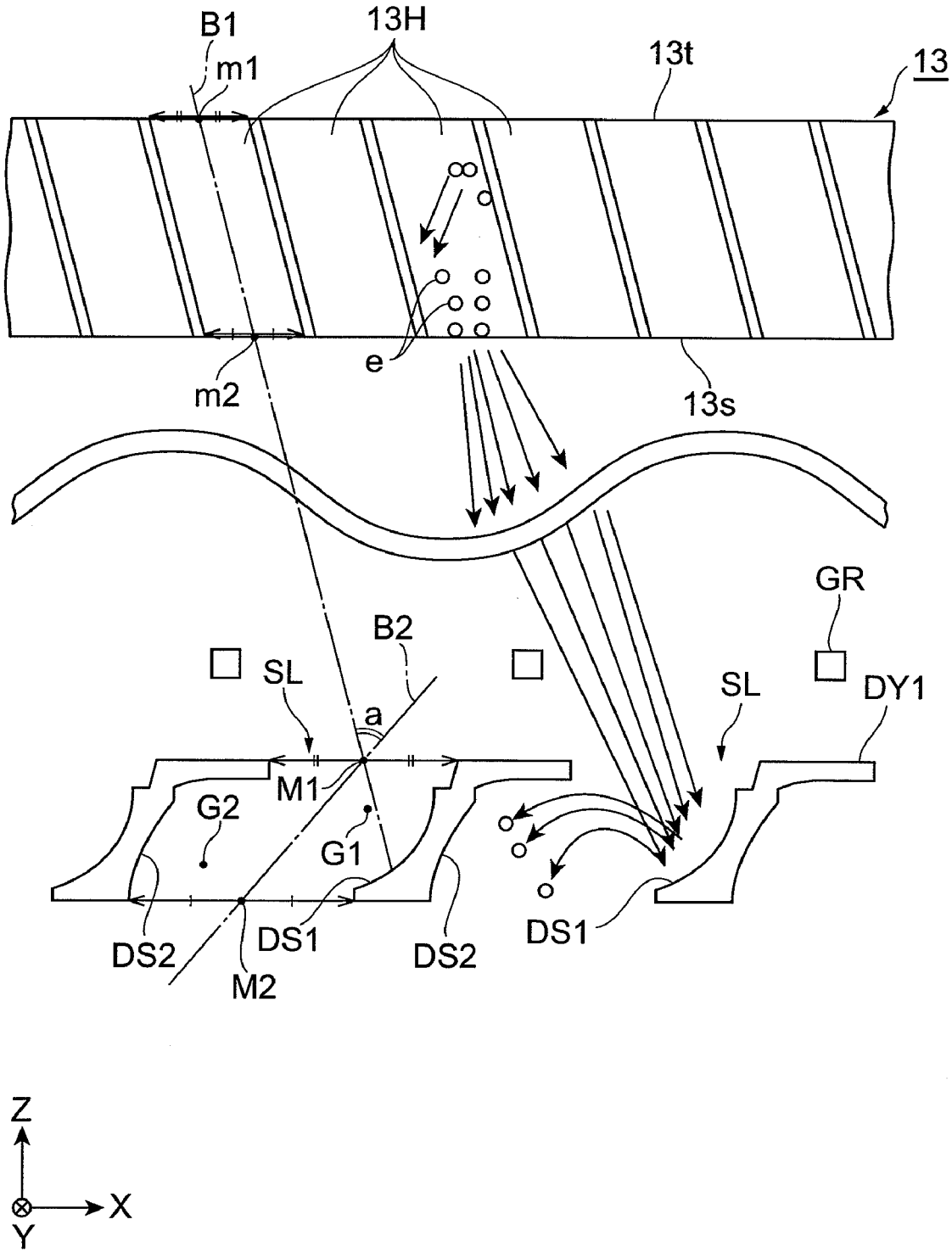
FIG. 3 is an enlarged view of the ion detector shown in FIG. 2 in the region III.

FIG. 3 is an enlarged view of the ion detector shown in FIG. 2 in the region III. These are disposed such that the inclinations of the slits SL in the planar dynode DY1 are alternate with respect to the inclinations of the channels (through holes 13H) of the MCP 13. Provided that these are disposed in this way, electrons emitted from the through holes 13H of the MCP 13 appropriately come into the effective portions (the insides of the slits) of the planar dynode DY1, which improves the collection efficiency of electrons. The details will be hereinafter described.

The respective through holes 13H in the MCP 13 to which the first stage planar dynode DY1 is opposed are inclined toward the thickness direction (the Z-axis direction) of the MCP 13. A straight line passing through the center of each of the through holes 13H is set as a first straight line B1. The first straight line B1 is a straight line passing through the axis of the through hole 13H. In FIG. 3, the first straight line B1 is a straight line connecting a midpoint m1 in the X-axis direction of an opening at the position of the ion incoming plane 13*t* of the through hole 13, and a midpoint m2 in the X-axis direction of an opening at the position of the electron emission plane 13*s*.

A group of electrons which are multiplied at the inner walls of the MCP 13 to be emitted from the electron emission plane 13 s attempts to be scattered at a slightly spread angle. However, the electrons are converged by the grid electrode GR existing short of the first stage planar dynode DY1, and collide against the interior surfaces of the planar dynode DY1. Here, a direction perpendicular to both of the longitudinal direction (the Y-axis direction) of the slits SL of the planar dynode DY1 and the thickness direction (the Z-axis direction) of the planar dynode DY1 is set as a width direction (the X-axis direction). FIG. 3 shows a cross section of the apparatus in the X-Z plane.

A straight line connecting a midpoint M1 in the width direction of an opening on the electron incoming plane side in the slit SL1 of the first stage planar dynode DY1, and a midpoint M2 in the width direction of an opening on the electron emission side is set as a second straight line B2. The first straight line B1 and the second straight line B2 intersect at a sharp angle of "a." The inclination of the first straight line B1 and the inclination of the second straight line B2 face in opposite directions to each other with respect to the thickness direction (the Z-axis direction). Given that Z is a function of X, the inclination of the first straight line B1 is negative and the inclination of the second straight line B2 is positive in the X-Z plane.

In this case, because the inclinations of the first straight line B1 and the second straight line B2 are opposite to each other, electrons emitted along the first straight line B1 from the MCP 13 are to efficiently come into an interior surface DS1 of the slit SL which is to be along the second straight line B2. Therefore, it is possible to improve the collection efficiency of electrons in the first stage dynode DY1. The interior surface DS1 of the slit SL faces an interior surface DS2, and a group of electrons multiplied to be reflected by the interior surface DS1 is reflected by the interior surface DS2, to come into the interior surface of the following stage dynode.

The interior surface DS1 is composed of a curved surface curved centering on a central axis G1, and the interior surface DS2 is composed of a curved surface curved centering on a central axis G2. The central axes G1 and G2 are both parallel to the Y-axis. These curved surfaces may be flat surfaces composing the straight lines in the X-Z plane, and their inclinations may be along the second straight line B2.

Note that the inclinations of straight lines having the same definition described above in the remaining dynodes DY2 to DY9 are negative in the even number dynodes, and are positive in the odd number dynodes, which allows efficient electron collection and electron multiplication to be performed.

Further, an offset distance (a gap) d between the planar dynode DY1 and the electron output plane 13*s* is preferably 1 to 5 mm, and more preferably 2 to 4 mm (3 mm in this example) from the standpoint that the in-plane gain uniformity (Gain Uniformity) is made higher, and transit time spread (T. T. S.) is inhibited.

In the case in which the distance d is short, the possibility that all the electrons output from one point of the MCP enter a dead region of the dynode is increased, which results in a reduction in the detection efficiency of ions. In the case in which the distance d is 3 mm, at least some of the electrons output from one point come into the active region to be multiplied. As a simulation result, the in-plane gain uniformity in this configuration is equal to or greater than 80%. Note that electrons coming into the dead region with the distance d of 3 mm are not multiplied effectively and simply act so as to lower the gain, but does not have an effect on the detection efficiency of ions.

On the other hand, when the distance d is long, electron transit time spread between the MCP and the dynodes is increased, which deteriorates a response time characteristic as an ion detector.

In the ion detector described above, provided that a multiplication factor of the MCP 13 is set to be low, that is approximately a thousand times, in order not to deplete a quantity of electrons output from the MCP 13, it is possible to retain the linearity. Because the planar dynodes DY1 to DY10 are stacked to further multiply electrons in the subsequent stage of the MCP 13, it is possible to retain the linearity of a quantity of output electrons to a quantity of incoming ions in a wide dynamic range while electrons are sufficiently multiplied.

In particular, each of the stacked planar dynodes DY1 to DY9 has the plurality of slits SL, electrons are multiplied at the interior surfaces of the slits SL, and the first stage planar dynode DY1 and the remaining dynodes DY2 to DY10 are opposed parallel to the electron output plane 13*s* of the MCP 13. Accordingly, electrons at each position in the planes of the planar dynodes advance together, and the electrons advance along the thickness direction of the dynodes while colliding against the interior surfaces of the slits SL so as not to widely meander. In this way, in accordance with this ion detector, it is possible to not only retain the linearity of outputs, but also accelerate its response speed.

Further, an outer diameter DK2 of the portion adjacent to the MCP 13 of the metal tube body K2 is slightly less than an outer diameter D13 of the MCP 13 parallel to the outer diameter DK2. Further, an outer diameter DK of the annular electrode Ka of the cathode electrode K is slightly less than an outer diameter D13 of the MCP 13 parallel to the outer diameter DK. That is D13−DK=Δ (refer to FIG. 1)=D13−DK2. In this case, because the electrode Ka on the ion incoming plane 13*t* side of the MCP 13 and the portion adjacent to the MCP 13 of the metal tube body K2 do not directly face each other, discharge therebetween is inhibited.

Further, the metal tube body K2 has the openings OP1 and OP2 in its side wall, and the inside of the metal tube body K2 and the outside thereof are communicated with each other via the openings OP1 and OP2. Because this ion detector is disposed in vacuum (in a decompression environment less than one atmospheric pressure) to an extent that it is possible for ions to fly linearly such as in a chamber of a mass spectroscope, the inside of the chamber serving as a vacuum apparatus and the inside of the metal tube body K2 are sufficiently communicated with the outside via the openings OP1 and OP2, which makes it possible to inhibit the emergence of a difference in atmospheric pressure between the inside of the chamber and the inside of the metal tube body K2, and to keep the degree of vacuum of the inside of the metal tube body K2 satisfactory.

Figure 4:
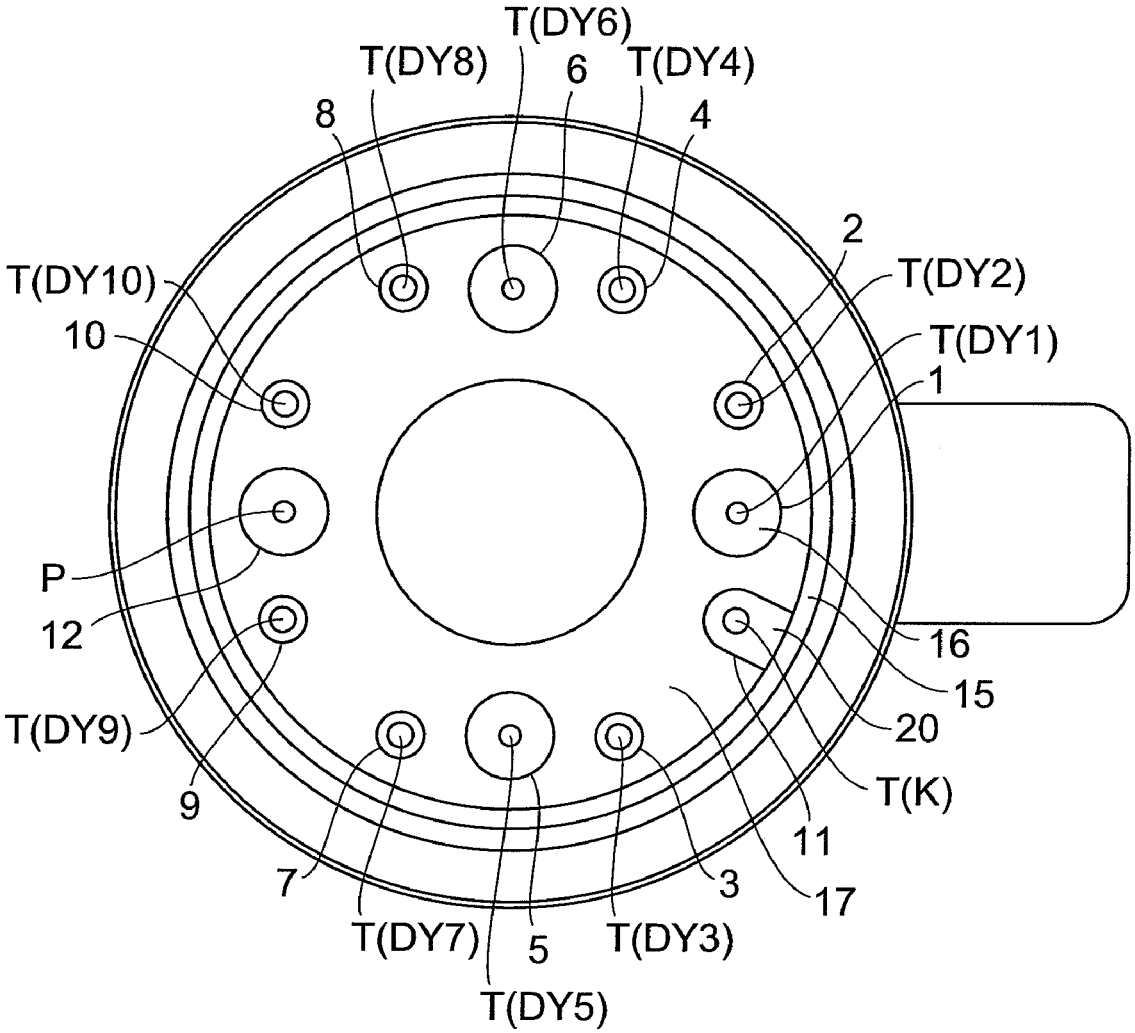
FIG. 4 is a bottom view of the ion detector.

FIG. 4 is a bottom view of the ion detector.

The insulating ring 17 has respective holes 1, 2, 3, 4, 5, 6, 7, 8, 9, 10, and 12 through which the lead pins T(DY1) to T(DY10), and T(K) and T(P) penetrate. The structure of the insulating ring 14 as well is the same as the structure of the insulating ring 17, and similarly, the lead pins penetrate through the holes in the insulating ring 14. Further, the plurality of lead pins T(DY1) to T(DY10) and T(P) penetrate through the inside of the insulating material 16.

The electrode 13 c on the electron output plane side of the MCP 13 is fixed to a conductive fixing member (conductive glass) 20 on the interior surface of the metal ring 15 which is fixed to the opening end of the metal tube body K2 and located under the metal tube body K2, and the electrode 13, the metal tube body K2, the metal ring 15, and the conductive fixing member 20 are electrically connected to each other. The lead pin T(K) is fixed to the conductive fixing member 20, and the lead pin T(K) is connected to the first stage planar dynode DY1 via a resistor R1 (refer to FIG. 5). Note that the conductive fixing member 20 is buried in the insulating material 16.

A bias voltage is applied to a portion between the electrode 13*b* on the ion incoming plane 13*t* side of the MCP 13 and the electrode 13*c* on the electron output plane 13*s* side of the MCP 13. The electrode 13*c* on the electron output plane 13*s* side is electrically connected to the first stage planar dynode DY1 via the metal tube body K2, the conductive fixing member 20, the lead pin T(K), the resistor R1, and the lead pin T(DY1). Accordingly, the MCP 13 and the first stage planar dynode DY1 can be electrically connected with a simple structure, which enables a voltage therebetween to be easily set through the resistor R1.

Figure 5:
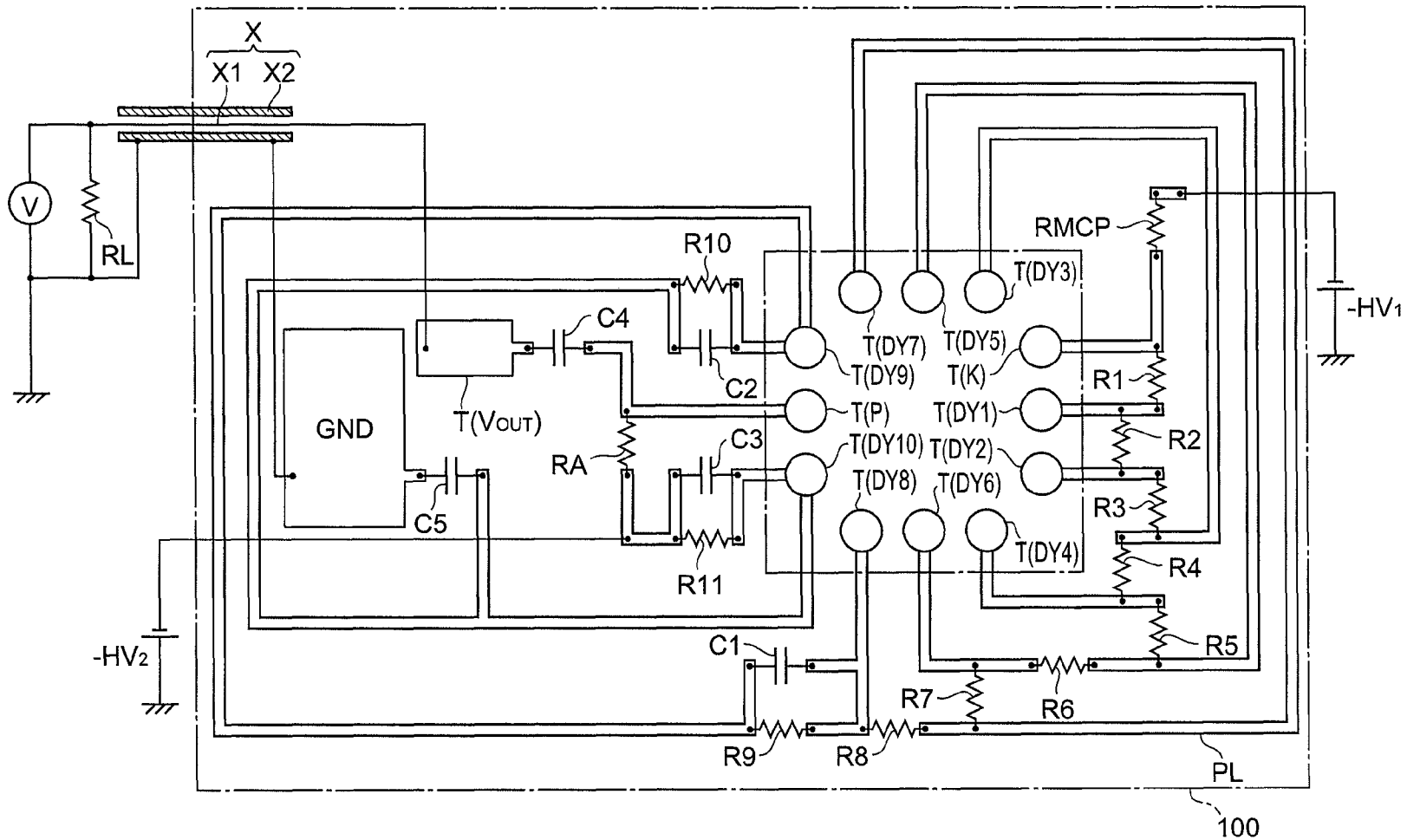
FIG. 5 is a plan view of a bleeder circuit connected to respective lead pins (terminals).
Figure 6:
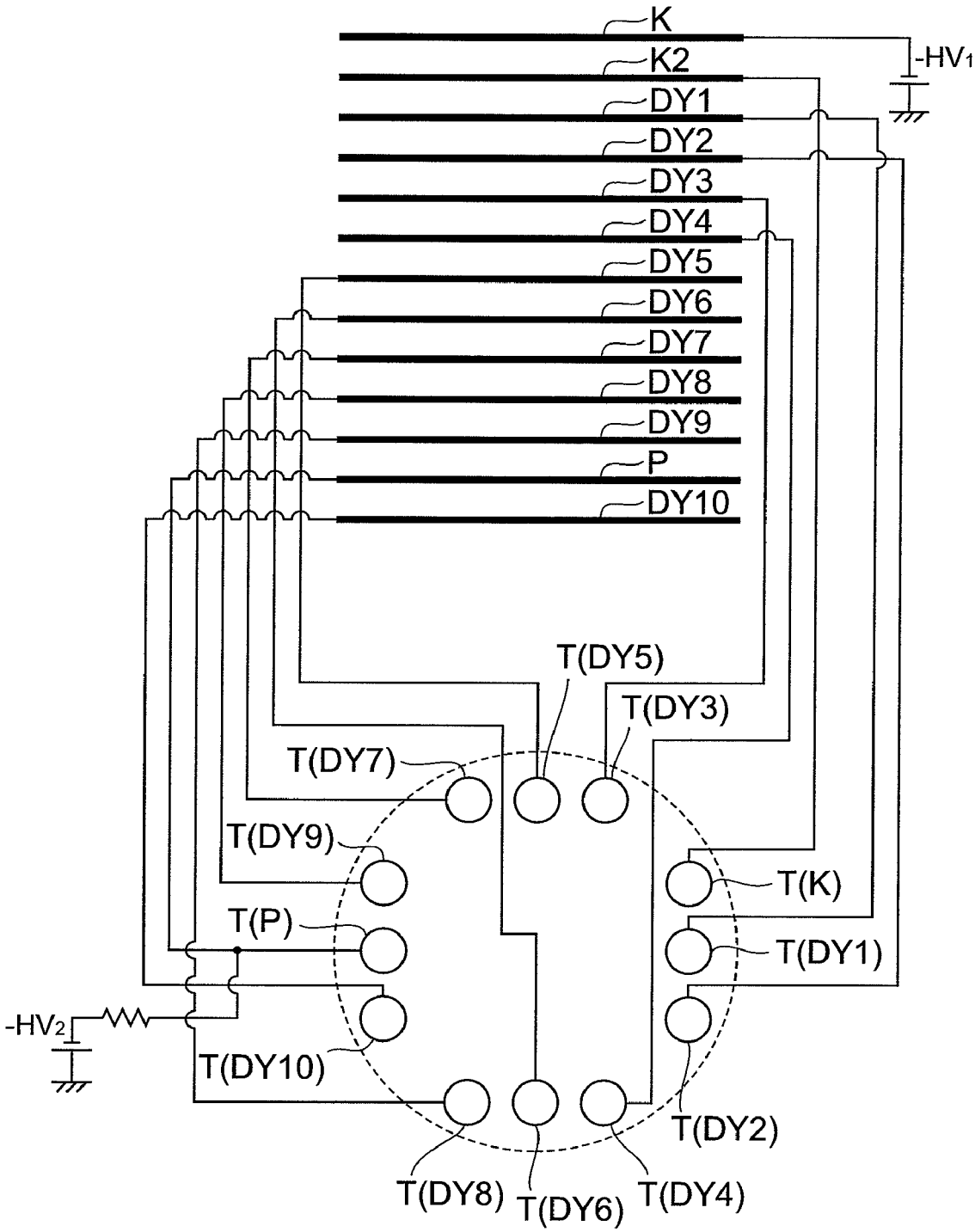
FIG. 6 is a view showing a relationship of connections between various types of electrodes and dynodes connected to the lead pins.

FIG. 5 is a plan view of a bleeder circuit connected to the respective lead pins (terminals), and FIG. 6 is a view showing a relationship of connections between various types of electrodes and dynodes connected to the lead pins.

A plurality of electrode pads T(DY1) to T(DY10), T(P), and T(K), and a printed wiring PL are formed on a wiring board 100 of insulation shown in FIG. 5. Here, as a matter of convenience, the same reference numerals and letters are used for the lead pins T(DY1) to T(DY10), T(P), and T(K), and the electrode pads T(DY1) to T(DY10), T(P), and T(K) to which these lead pins are connected, and the both are called terminals. The wiring board 100 is made of polyimide, and various types of resistors and capacitors as well are disposed on the wiring board 100.

A voltage of a power source ($-HV_1$) is −5 kV, and the power source is connected to the tab electrode Kb of the cathode electrode K, and the tab electrode Kb is connected to the one electrode of the MCP 13. The metal tube body K2 connected to the other electrode of the MCP 13 is connected to the negative pole of the power source ($-HV_1$) via the terminal T(K) and a resistor RMCP. Accordingly, a bias voltage is applied to a portion between the cathode electrode K and the metal tube body K2 via the resistor RMCP. An electric potential at the terminal T(K) is set to −4 kV, and a bias voltage of the MCP is set to 1 kV.

Provided that the metal tube body K2 serves as the terminal T(K) of the cathode, this is connected to the terminal T(DY1) via the resistor R1, and the terminal T(DY1) is connected to the terminal T(DY2) via a resistor R2. In the same way, the terminal T(DY2) is connected to the terminal T(DY3) via a resistor R3, the terminal T(DY3) is connected to the terminal T(DY4) via a resistor R4, the terminal T(DY4) is connected to the terminal T(DY5) via a resistor R5, the terminal T(DY5) is connected to the terminal T(DY6) via a resistor R6, the terminal T(DY6) is connected to the terminal T(DY7) via a resistor R7, and the terminal T(DY7) is connected to the terminal T(DY8) via a resistor R8. The terminal T(DY8) is connected to the terminal T(DY9) via a resistor R9 and a capacitor C1 parallel to the resistor R9, and the terminal T(DY9) is connected to the terminal T(DY10) via a resistor R10 and a capacitor C2 parallel to the resistor R10. The respective terminals are respectively connected to the dynodes.

The terminal T(DY10) is connected to the terminal T(P) via a resistor R11, a capacitor C3 parallel to the resistor R11, and a resistor RA. Note that capacitors are inserted parallel to the resistors in the subsequent stage of the dynode line. Provided that the capacitors are connected in this way, it is possible to supply an instantaneous current from the capacitors to the dynodes, which makes it possible to achieve the higher linearity with respect to pulsed input signals.

Further, the terminal T(P) is connected to the anode P, and the terminal T(P) is connected to an output terminal T($V_{out}$) via a capacitor (coupling capacitor) C4. The capacitor C4 cuts out a direct-current component from a signal output from the anode P. The output terminal T($V_{out}$) is connected to one end of a voltmeter V via an inner conductor X1 of a coaxial cable (connector) X. The other end of the voltmeter V is connected to the ground, and a load resistor RL is connected between the both ends of the voltmeter V. In this example, because the coaxial cable X is used, it is difficult for noise to be mixed in a signal. Because the capacitor C4 is connected to the anode P, an output signal from the anode P can be converted to a signal at a GND level to be output.

Note that the terminal T(DY10) to which the final stage dynode DY10 is connected is connected to a ground terminal (GND) via a capacitor C5. The ground terminal (GND) is connected to an outer conductor X2 of the coaxial cable X. Further, another capacitor C5 is connected between the final stage dynode DY10 and the outer conductor (ground potential) X2 of the coaxial cable X, that improves the high frequency characteristic. Further, the terminal T(P) and the terminal T(DY10) are respectively connected to a second power source ($-HV_2$) via the resistors. The value of a negative potential of the second power source ($-HV_2$) is −3 kV.

As described above, a bias voltage is applied to a portion between the outer electrode (cathode electrode K) 13*b* of the MCP 13 and the inner electrode 13*c* of the MCP from the bleeder circuit. Voltages are divided by the resistors to be supplied to the respective stages of the MCP 13 and the dynodes. Ions coming into the ion detector to which the bias voltage is supplied are converted into electrons by the MCP 13, and the generated secondary electrons are multiplied a thousand times by the MCP 13. Next, the electrons come into the dynodes DY1 to DY10, and further, are multiplied a thousand times to be output. A direct-current component of an output signal is cut out by the capacitor C4, and only an alternate current component is output. In accordance with such a configuration, it is possible to measure every single ion coming into the ion detector with high time resolution.

The present charged-particle ion detector is capable of detecting not only positive ions, but also negative ions. For example, by applying 5 kV and 7 kV respectively to the first and second power sources ($-HV_1$) and ($-HV_2$), the incoming plane side of the MCP is made to have a positive potential, that is capable of drawing negative ions, and therefore, it is possible to measure the negative ions in the same way. Further, it is possible to detect electrons as well with the same technique.

The above-described ion detector has the high time response characteristic. A pulse width of an electron flow output from only the MCP when a single ion comes into the MCP is less than or equal to 300 ps. Further, a pulse width of an output signal from only the dynodes DY1 to DY10 formed of stacked metals is expected to be less than or equal to 1 ns. When a simulation has been run with the configuration of the ion detector, 600 ps has been acquired as a pulse width of an output signal. Note that, a rise time less than or equal to 2 ns is necessary for an ion detector used in a TOF type mass spectroscope. Such a time response characteristic cannot be achieved by merely combining two high-speed electron multipliers. It is particularly important that the dynodes are tabular and face parallel to the MCP. Thereby, it is possible to minimize a time difference until electrons output from the MCP enter into the dynode, that provides a high-speed response characteristic. Further, the MCP is fixed on the basis of the stem by the metal tube body in order to dispose both accurately in parallel. On the other hand, the dynodes as well are accurately fixed on the basis of the stem.

Further, the above-described ion detector is high in its linearity of output signals with respect to incoming ions. Although an MCP generally has a high-speed characteristic, the upper limit of the dynamic range is limited to approximately 5 μA. The reason for this is that, because the channel wall of the MCP is highly-resistive, when an incoming current becomes high, charges are depleted, which makes it impossible to multiply electrons. In the present detector, because the portion to multiply a large quantity of electrons is composed of the dynodes, it is possible to secure the high linearity within a range reaching mA order.

Note that, on the condition that the ion detector is composed of only line-type dynodes in a photoelectron multiplier, its ion incoming plane is not flat, and it is therefore estimated that the response time characteristic of an output signal is greater than 10 ns. Because it is impossible to sufficiently perform mass separation with such a response characteristic, this ion detector cannot be applied to a TOF type mass spectroscope. Further, on the condition that two MCPs are stacked for use, a high-speed response characteristic less than or equal to ns order is secured. However, the dynamic range thereof remains narrow as described above. Accordingly, in an apparatus requesting a wide dynamic range such as a MALDI-TOF (matrix-assisted laser desorption/ionization time-of-flight) type mass spectroscope, the use thereof is limited.

On the other hand, an ion detector may be composed of only dynodes formed of the stacked metals used for the present ion detector. However, in this case, its detection efficiency is to be a problem. That is, in a typical dynode formed of a metal plate, a region in which it is possible to effectively convert ions into electrons and multiple those is approximately 30% of its entire area, which results in a low detection efficiency. In the present ion detector, because the MCP serves as an ion-to-electron conversion plane, it is possible to achieve a detection efficiency greater than 60%.

Further, in order to achieve a gain of $10^6$ with only dynodes, it is necessary to laminate dynodes in approximately seventeen stages. In the case in which the number of laminations is increased in this way, it is difficult to secure an assemble accuracy, and a waveform of output signals is distorted, which leads to a slightly-lower response speed. Because the present ion detector achieves a thousandfold gain by the MCP, it is possible to achieve a necessary gain by the dynodes in ten stages. It is a matter of course that the number of dynodes is not limited in the present invention.

Note that, on the condition that the present ion detector is configured such that the order of the MCP and the dynode is changed, to cause ions to come into the dynode, there is provided an ion detector with a low ion detection efficiency and the low linearity. The order in the multiplication part of the present ion detector is important. Moreover, there is the feature that the present ion detector is more compact as compared with an ion detector composed of only line-type dynodes.

As described above, the present ion detector exhibits a higher speed response characteristic and is more compact as compared with an ion detector composed of general dynodes. Moreover, there is the feature that the present ion detector has a wider dynamic range as compared with an ion detector composed of an MCP. In accordance with the simulation described above, in this ion detector, it is possible to obtain output signals having the linearity reaching several mV, and shorten its pulse width to approximately 600 ps. Note that the ions described above may be read as charged particles such as electrons.

What is claimed is:

1. A charged-particle detector comprising:

a micro-channel plate; and a plurality of planar dynodes respectively having a plurality of slits, wherein the plurality of planar dynodes are stacked via spacers parallel to an electron output plane of the micro-channel plate, and the first stage planar dynode is opposed parallel to the electron output plane.

2. The charged-particle detector according to claim 1, wherein each channel of the micro-channel plate to which the first stage dynode is opposed is inclined toward the thickness direction of the micro-channel plate, and assuming that a straight line passing through the center of each channel is set as a first straight line, a direction perpendicular to both of the longitudinal direction of the slits and the thickness direction of the planar dynodes is set as a width direction, and a straight line connecting a midpoint in the width direction of an opening on an electron incoming plane side and a midpoint in the width direction of an opening on an electron emission side in the slit of the first stage planar dynode is set as a second straight line, an inclination of the first straight line and an inclination of the second straight line face in opposite directions to each other with respect to the thickness direction.

3. The charged-particle detector according to claim 1, wherein an electrode on the electron output plane side of the micro-channel plate includes a metal tube body fixed to its opening end, a conductive fixing member electrically connected to the metal tube body, a lead pin which is fixed to the conductive fixing member, and is connected to the first stage planar dynode via a resistor, and an insulating material into which the conductive fixing member is buried.

4. The charged-particle detector according to claim 3, wherein an outer diameter of a portion adjacent to the micro-channel plate of the metal tube body is less than an outer diameter of the micro-channel plate parallel to the outer diameter.

5. The charged-particle detector according to claim 3, wherein the metal tube body has openings in its side wall, and the inside of the metal tube body and the outside thereof are communicated with each other via the openings.

6. The charged-particle detector according to claim 4, wherein the metal tube body has openings in its side wall, and the inside of the metal tube body and the outside thereof are communicated with each other via the openings.

* * * * *